US009357892B2

(12) United States Patent
Pang Kim Pong et al.

(10) Patent No.: US 9,357,892 B2
(45) Date of Patent: Jun. 7, 2016

(54) VORTEX-FLOW VACUUM SUCTION NOZZLE

(75) Inventors: Henry Pang Kim Pong, Singapore (SG); Ronnie Tan Kwang Liang, Singapore (SG); Siantar Tanioes, Singapore (SG)

(73) Assignee: Seagate Technology LLC, Scotts Valley, CA (US)

( * ) Notice: Subject to any disclaimer, the term of this patent is extended or adjusted under 35 U.S.C. 154(b) by 2507 days.

(21) Appl. No.: 11/724,894

(22) Filed: Mar. 16, 2007

(65) Prior Publication Data

US 2007/0266521 A1 Nov. 22, 2007

Related U.S. Application Data

(60) Provisional application No. 60/747,558, filed on May 18, 2006.

(51) Int. Cl.
*A47L 9/02* (2006.01)
*A47L 7/00* (2006.01)

(52) U.S. Cl.
CPC . *A47L 9/02* (2013.01); *A47L 7/0009* (2013.01)

(58) Field of Classification Search
CPC ..... A47L 9/02; A47L 9/242; A47L 7/0009; A47L 9/0613; A47L 9/06; A47L 9/1625; A47L 5/362; A47L 9/0009; A47L 9/106
USPC ..... 15/415.1, 420, 421, 339, 398, 417; 406/92
See application file for complete search history.

(56) References Cited

U.S. PATENT DOCUMENTS

| | | | | | |
|---|---|---|---|---|---|
| 2,027,543 | A | * | 1/1936 | Lofgren | 15/420 |
| 3,075,227 | A | | 1/1963 | Bowles | |
| 3,238,557 | A | | 3/1966 | Foster | |
| 3,626,265 | A | * | 12/1971 | Kraakman | 418/266 |
| 3,692,245 | A | * | 9/1972 | Needham et al. | 239/488 |
| 3,963,515 | A | | 6/1976 | Haldeman et al. | |
| 4,260,110 | A | * | 4/1981 | Werding | 239/404 |
| 4,282,626 | A | * | 8/1981 | Schneider | 15/320 |
| 4,677,705 | A | * | 7/1987 | Schuster | 15/398 |
| 4,706,888 | A | * | 11/1987 | Dobbs | 239/478 |
| 4,866,565 | A | * | 9/1989 | Wray, Jr. | 361/215 |
| 4,915,245 | A | | 4/1990 | Wouters et al. | |
| 5,253,538 | A | | 10/1993 | Swick et al. | |
| 5,765,259 | A | * | 6/1998 | Cika | 15/394 |
| 5,924,823 | A | * | 7/1999 | Palffy | 406/152 |
| 5,967,423 | A | * | 10/1999 | Sumida et al. | 239/533.12 |
| 5,987,700 | A | * | 11/1999 | Edlund | 15/420 |
| 6,292,970 | B1 | * | 9/2001 | Rief et al. | 15/1.7 |
| 6,421,875 | B1 | * | 7/2002 | Coombs et al. | 15/420 |
| 6,439,482 | B2 | * | 8/2002 | Hosoyama et al. | 239/463 |

(Continued)

*Primary Examiner* — Robert Scruggs
(74) *Attorney, Agent, or Firm* — Hall Estill Attorneys at Law

(57) ABSTRACT

A vacuum suction nozzle comprises a nozzle body comprising a first end and a second end, a nozzle passage extending through the nozzle body from the first end to the second end, and a plurality of channels traversing the first end. The channels enter the nozzle passage tangentially. Each channel may be wider proximate an outer surface of the nozzle body than proximate the nozzle passage. A vacuum system comprises the nozzle and a vacuum generator coupled to the nozzle. A method for vacuum cleaning comprises inducing a vortex flow proximate the nozzle with a vacuum generator, and translating the nozzle generally parallel to a surface to remove particulates from the surface.

19 Claims, 6 Drawing Sheets

(56) References Cited

U.S. PATENT DOCUMENTS

| | | | | |
|---|---|---|---|---|
| 6,461,086 | B1 * | 10/2002 | Milanowski et al. | 406/92 |
| 6,687,951 | B2 | 2/2004 | Illingworth et al. | |
| 6,689,225 | B2 | 2/2004 | Illingworth | |
| 6,719,830 | B2 | 4/2004 | Illingworth et al. | |
| 6,771,371 | B2 | 8/2004 | Sherwin | |
| 6,811,687 | B2 | 11/2004 | Illingworth et al. | |
| 6,957,472 | B2 | 10/2005 | Illingworth et al. | |
| 7,111,797 | B2 | 9/2006 | Bezama et al. | |
| 7,210,197 | B2 * | 5/2007 | Fedorka et | 15/420 |
| 2005/0066471 | A1 * | 3/2005 | Miller et al. | 15/401 |
| 2005/0214109 | A1 * | 9/2005 | Grande et al. | 415/90 |
| 2007/0215723 | A1 * | 9/2007 | Moser et al. | 239/492 |

* cited by examiner

VORTEX-FLOW VACUUM SUCTION NOZZLE

CROSS-REFERENCE TO RELATED APPLICATION(S)

This application claims benefit from a provisional patent application Ser. No. 60/747,558 entitled VORTEX-FLOW VACUUM SUCTION NOZZLE, filed on May 18, 2006.

BACKGROUND OF THE INVENTION

The present invention relates generally to vacuum cleaning systems, and in particular to vacuum suction nozzles.

Commercial vacuum cleaning systems employ various nozzle designs. Generally speaking, brush-and-roller nozzles are applied to common heavy textile surfaces such as rugs and carpeting, while other nozzles and attachments are available for more particular applications such as draperies, upholstery, and other surfaces.

Surfaces of clean room fixtures and other sensitive equipment can exhibit low tolerances for particulates and other debris, demanding correspondingly high levels of cleaning efficacy. At the same time, the surfaces may be extremely sensitive to scratching and cross-contamination, making brush-and-roller and other existing nozzles and attachment designs unsuitable.

Thus there remains a need for a vacuum suction nozzle suitable for clean room and other sensitive vacuum cleaning applications.

BRIEF SUMMARY OF THE INVENTION

The vacuum suction nozzle of the various embodiments overcomes deficiencies of existing vacuum systems by including a vortex-flow nozzle design. The vacuum suction nozzle generally includes a nozzle body having first and second ends, a nozzle passage extending through the nozzle body from the first end to the second end, and a plurality of channels traversing the first end and entering the nozzle passage tangentially. The channels may be relatively wider at an outer surface of the nozzle body than at the nozzle passage, and are operative to induce a vortex flow in proximity to the nozzle. The nozzle may also comprise a coupling adapter, adapted for coupling to a vacuum receiving element.

In various embodiments there are four channels, each defining a tangent opening angle of approximately thirty degrees. In further embodiments the nozzle may be coupled to a vacuum generator to create a vortex-flow vacuum cleaning system effective for the removal of particulates and other debris. This system may be a non-contact vacuum system, in which no contact is required between the nozzle and the surface to be cleaned.

DETAILED DESCRIPTION

Figure 1:
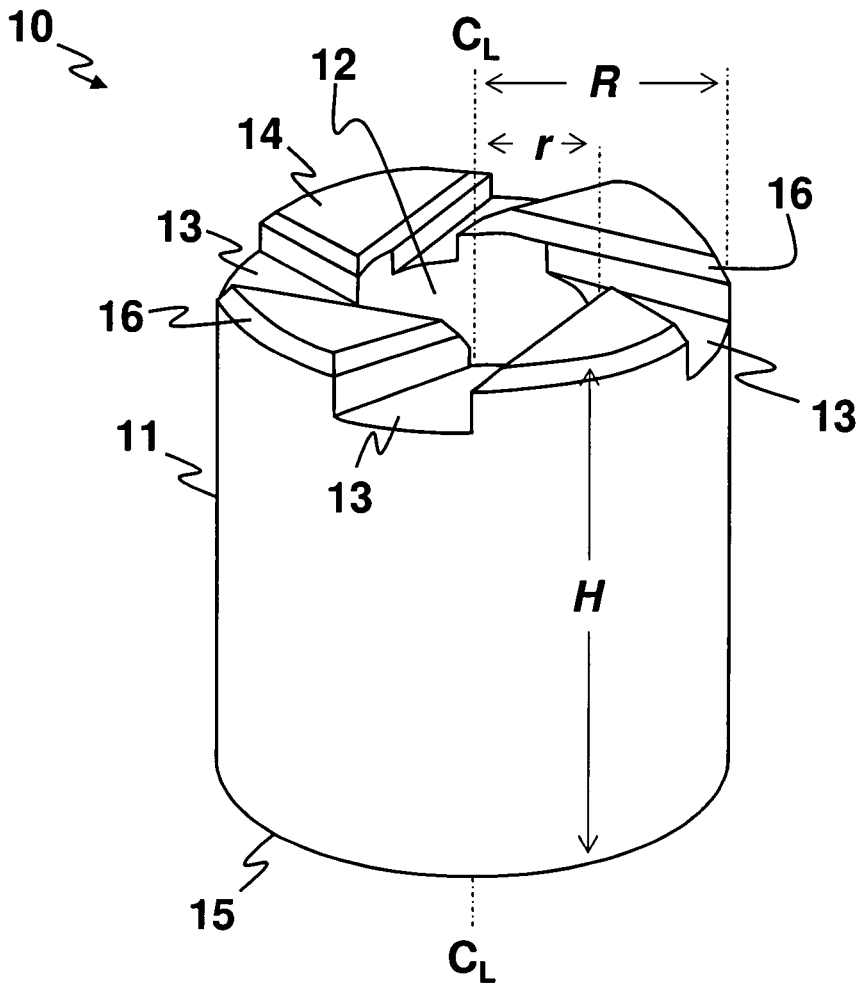
FIG. 1 is a perspective view of a vortex-flow vacuum suction nozzle according to an embodiment.

FIG. 1 is a perspective view of vortex-flow vacuum suction nozzle 10, according to an embodiment. Nozzle 10 comprises nozzle body 11, nozzle passage 12 and channels 13.

Nozzle body 11 comprises first end 14 and second end 15. In the embodiment illustrated by FIG. 1, nozzle body 11 has a generally cylindrical geometry, characterized by nozzle body height H and outer radius R.

FIG. 1 illustrates an embodiment in which outer radius R is approximately equal to one half of height H, but in other embodiments these dimensions may vary. Nozzle body 11 may also have an oval, triangular, square, rectangular, or other geometric cross section, or an irregular cross section. In these embodiments outer radius R is a greatest perpendicular dimension of nozzle body 11, measured from axial centerline $C_L$ to a perimeter of nozzle body 11.

Nozzle passage 12 also has a generally cylindrical geometry, extending along height H, with inner radius r. In an upright orientation as shown in FIG. 1, nozzle passage 12 extends down through first end 14 and second end 15 of nozzle body 11, along axial centerline $C_L$. In this embodiment inner radius r is approximately equal to one half of outer radius R, but in other embodiments these dimensions may vary.

Channels 13 are presented on first end 14 of nozzle body 11. Channels 13 traverse first end 14 of nozzle body 11, from outer radius R to inner radius r at nozzle passage 12. Channels 13 can further have a variable width that is relatively wider proximate outer radius R, and relatively narrower proximate inner radius r. Channels 13 enter nozzle passage 12 tangentially at inner radius r, and are operative to induce vortex flow in proximity to nozzle 10 at first end 14 of nozzle body 11.

In the embodiment illustrated by FIG. 1, there are four channels 13. In other embodiments the number of channels may vary from at least two to six or more. Channels 13 may further comprise bevel 16 presented on first end 14, extending along a perimeter of each channel 13 and along outer radius R of nozzle body 11. In this embodiment channels 13 and bevel 16 form an intake lip on first end 14 of nozzle body 11. Note that height H of nozzle body 11 includes optional bevel 16.

Second end 15 is adapted for coupling to a vacuum system receiving element. In one embodiment, second end 15 is adapted proximate inner radius r of nozzle passage 12, such that second end 15 forms a detachable friction coupling by sliding over the receiving element. Second end 15 may also be adapted for a snap-on coupling, or tapped to facilitate a threaded coupling at either inner radius r or outer radius R. Other couplings, such as adhesive couplings, are also possible without departure from features of nozzle 10.

Figure 2:
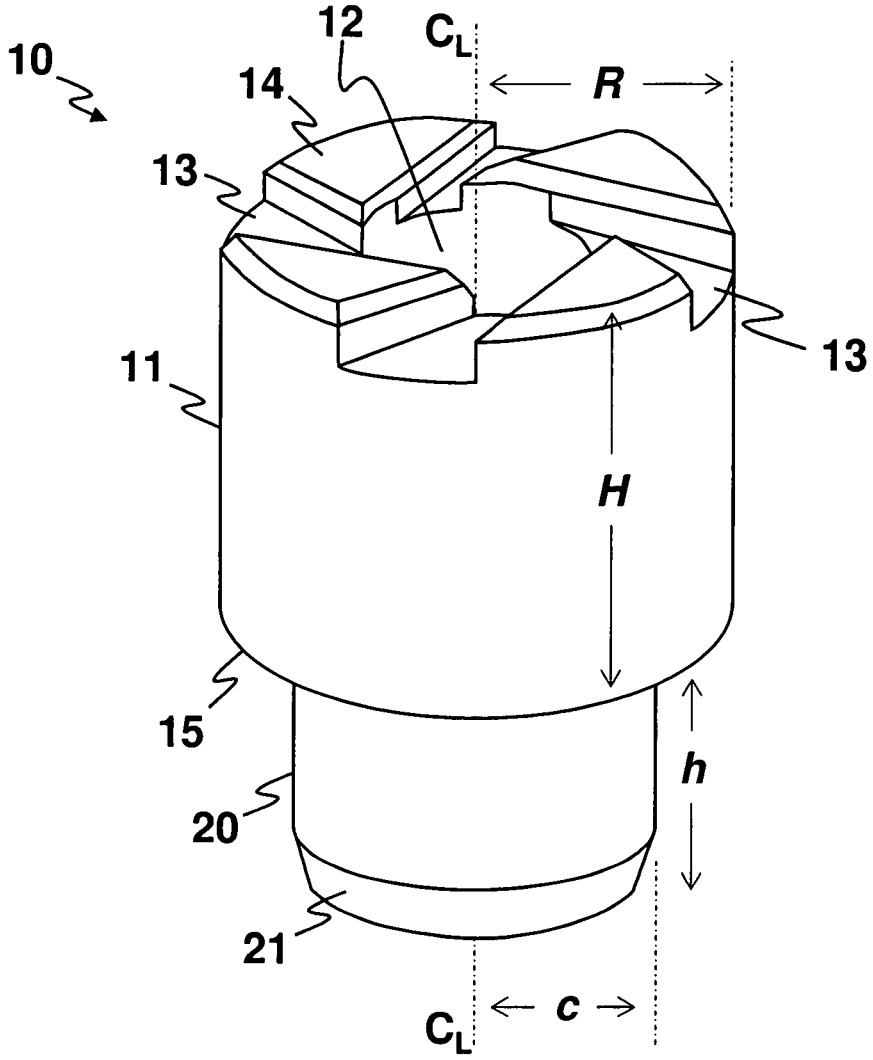
FIG. 2 is a perspective view of a vortex-flow vacuum suction nozzle with a coupling adapter.

FIG. 2 is a perspective view of vortex-flow vacuum suction nozzle 10, with coupling adapter 20. Nozzle 10 comprises nozzle body 11, nozzle passage 12 and channels 13. Coupling adapter 20 is located on second end 15 of nozzle body 11. Nozzle passage 12 extends through both nozzle body 11 and coupling adapter 20, along axial centerline $C_L$.

In the embodiment illustrated by FIG. 2, coupling adapter 20 has a generally cylindrical geometry characterized by coupling height h, approximately equal to two thirds of nozzle body height H, and coupling radius c, approximately equal to two thirds of outer radius R. In other embodiments these dimensions may vary. Coupling adapter 20 may also have a non-cylindrical or irregular geometry, as described for nozzle body 11, above, with respect to FIG. 1. For irregular geometries coupling radius c is a greatest perpendicular dimension from axial centerline $C_L$ to a perimeter of coupling adapter 20.

Coupling adapter 20 is adapted for coupling to a vacuum system receiving element, analogously to second end 15 of nozzle body 11. In contrast to second end 15, however, coupling adapter 20 provides coupling dimension c, which may be adapted for coupling independently of outer radius R of the nozzle body. Coupling adapter 20 may be adapted for coupling proximate inner radius r of nozzle passage 12, proximate coupling radius c, or, in other embodiments, proximate optional coupling bevel 21.

Figure 3:
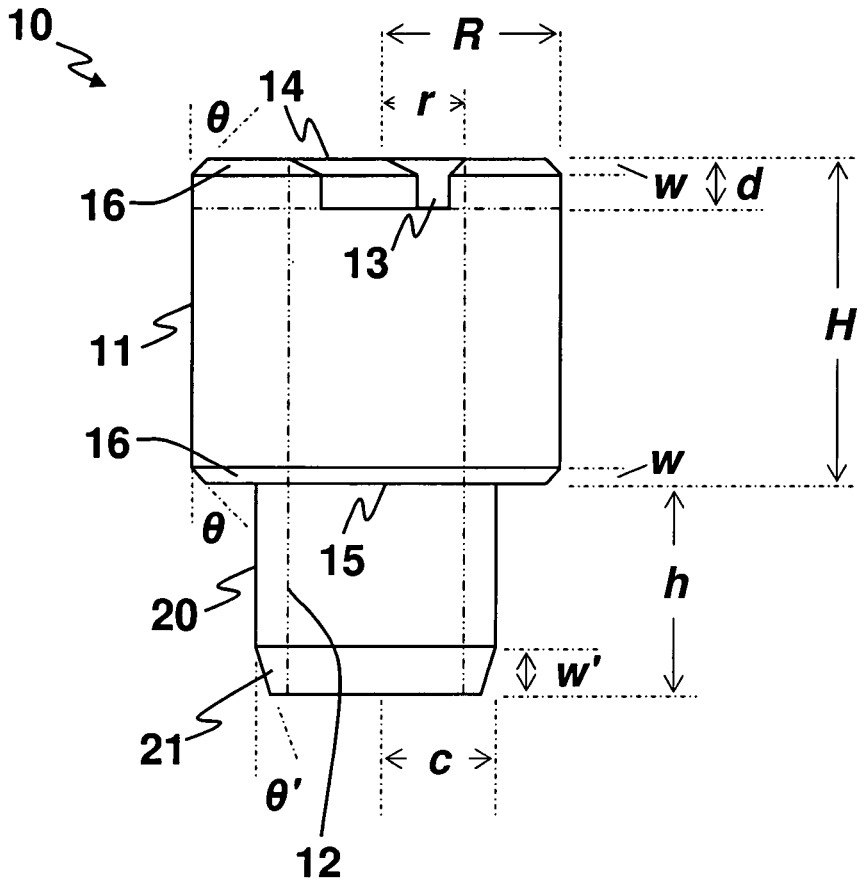
FIG. 3 is a side view of the vortex-flow vacuum suction nozzle of FIG. 2.

FIG. 3 is a side view of the vortex-flow vacuum suction nozzle of FIG. 2, showing nozzle body 11, passage 12, channels 13 and coupling adapter 20. Nozzle passage 12 is shown in phantom.

In the embodiment illustrated by FIG. 3, inner radius r of nozzle passage 12 is uniform through first end 14 and second end 15 of nozzle body 11, and through optional coupling adapter 20. In other embodiments inner radius r may vary, in particular to facilitate coupling either at second end 15 of nozzle body 11, or at optional coupling adapter 20.

Channels 13 are presented in first end 14 of nozzle body 11. Channels 13 have depth d. In this embodiment depth d is approximately one sixth of nozzle body height H.

Optional bevel 16 has bevel angle θ and bevel width w, as presented on channels 13 and nozzle body 11 at outer radius R, proximate first end 14. In the embodiment illustrated by FIG. 3, bevel angle θ is approximately forty-five degrees and bevel width w is approximately one third of channel depth d. In other embodiments these dimensions may vary. Bevel 16 may also be presented on nozzle body 11 at outer radius R, proximate second end 15. In this embodiment the dimensions of bevel 16 may vary from those as presented proximate first end 14.

Optional coupling bevel 21 is presented on coupling adapter 20, with coupling bevel angle θ' and coupling bevel width w'. In the embodiment illustrated by FIG. 3, coupling bevel angle θ' is approximately twenty degrees and coupling bevel width w' is approximately one fifth of coupling height h, but in other embodiments these dimensions may vary.

FIG. 3 illustrates that features of nozzle 10 are relatively insensitive to scale; that is, dimensions of nozzle 10 are relative and approximate, rather than absolute and precise. This results from a scale independence that is characteristic of vortex flow, as manifested in such widely-ranging phenomena as micro-fluidic eddy flow, vacuum suction nozzles, and large-scale atmospheric disturbances. This relative invariance allows nozzle 10 to be adapted to a wide variety of applications, without altering its fundamental utility.

Figure 4:
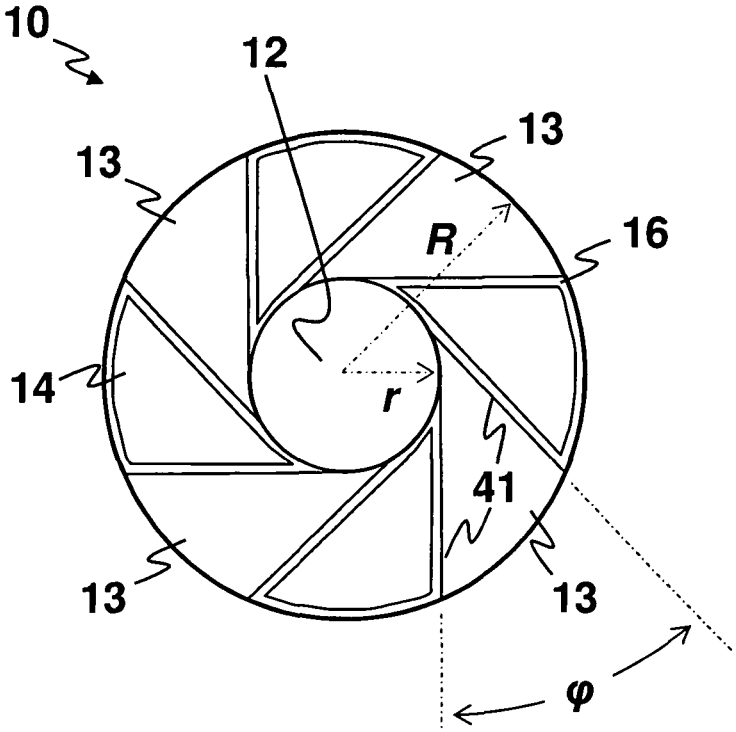
FIG. 4 is a top view of the vortex-flow vacuum suction nozzle of FIG. 1.

FIG. 4 is top view of vortex-flow vacuum suction nozzle 10, as shown in FIG. 1. FIG. 4 shows first end 14 of nozzle body 11, nozzle passage 12 and channels 13.

FIG. 4 illustrates the variable width of channels 13, characterized by tangent opening angle ϕ as measured between channel walls 41. In one embodiment, tangent opening angle ϕ is approximately thirty degrees, but in other embodiments the angle may vary from this value.

Channels 13 with tangent opening angle ϕ have characteristic design features. For example, a fluid flowing through each channel 13 enters nozzle passage 12 tangentially because each channel 13 intersects the passage 12 tangentially, providing effective vortex flow proximate inner radius r. By this it is meant that the channel walls 41 defining channels 13 are each tangential to the radius surface defining the nozzle passage 12, producing a cooperative enhancement to vortex flow, not only inside nozzle passage 12 but also between inner radius r and outer radius R.

Further, in these illustrative embodiments the channel walls 41 with tangent opening angle .phi. provide an increasing channel width as channels 13 traverse first end 14, from inner radius r of nozzle passage 12 to outer radius R of nozzle body 11. This increasing width provides high flow velocity within nozzle passage 12, and high flow volume proximate outer radius R of nozzle body 11 at first end 14. This flow is operative to induce the removal of particulates and other debris not only from within nozzle passage 12, but also from other regions proximate nozzle 10. These regions may be outside inner radius r, and even outside outer radius R. In those illustrative embodiments the channels 13 are wider at the inlets because the channel walls 41 are straight. Although not depicted, in alternative equivalent embodiments the channels 13 can likewise intersect the nozzle passage 12 tangentially but can otherwise have partially or entirely arcuate channel walls that define constant width or varying width channels.

Nozzle 10 of FIG. 4 may be formed of a static dissipative material, discouraging electrostatic attraction to nozzle 10. This embodiment provides improved cleaning efficacy, and reduces the possibility of cross-contamination due to the transport of statically-attracted particulates or other debris. Nozzle 10 may also be machinable, to facilitate formation of channels 13 by step-down cutting or other milling or mechanical process. Nozzle 10 may further be wear resistant and lubricious, providing additional advantages in embodiments where the nozzle may come into contact with the surface to be cleaned. In one embodiment, nozzle 10 is formed from Pomalux SD-A, a non-carbon-filled acetal copolymer available from Westlake Plastics Company of Lenni, Pa., which is static dissipative, machinable, wear resistant and lubricious.

Nozzle 10 of FIGS. 1-4 is representative of a range of embodiments directed toward the removal of particulates and other debris from clean room fixtures and other sensitive fabrication surfaces. Nozzle 10 is further applicable to both gaseous and liquid fluid flows, including pool cleaning and other underwater applications, as well as pipelines and other industrial fluid flow applications.

Figure 5:
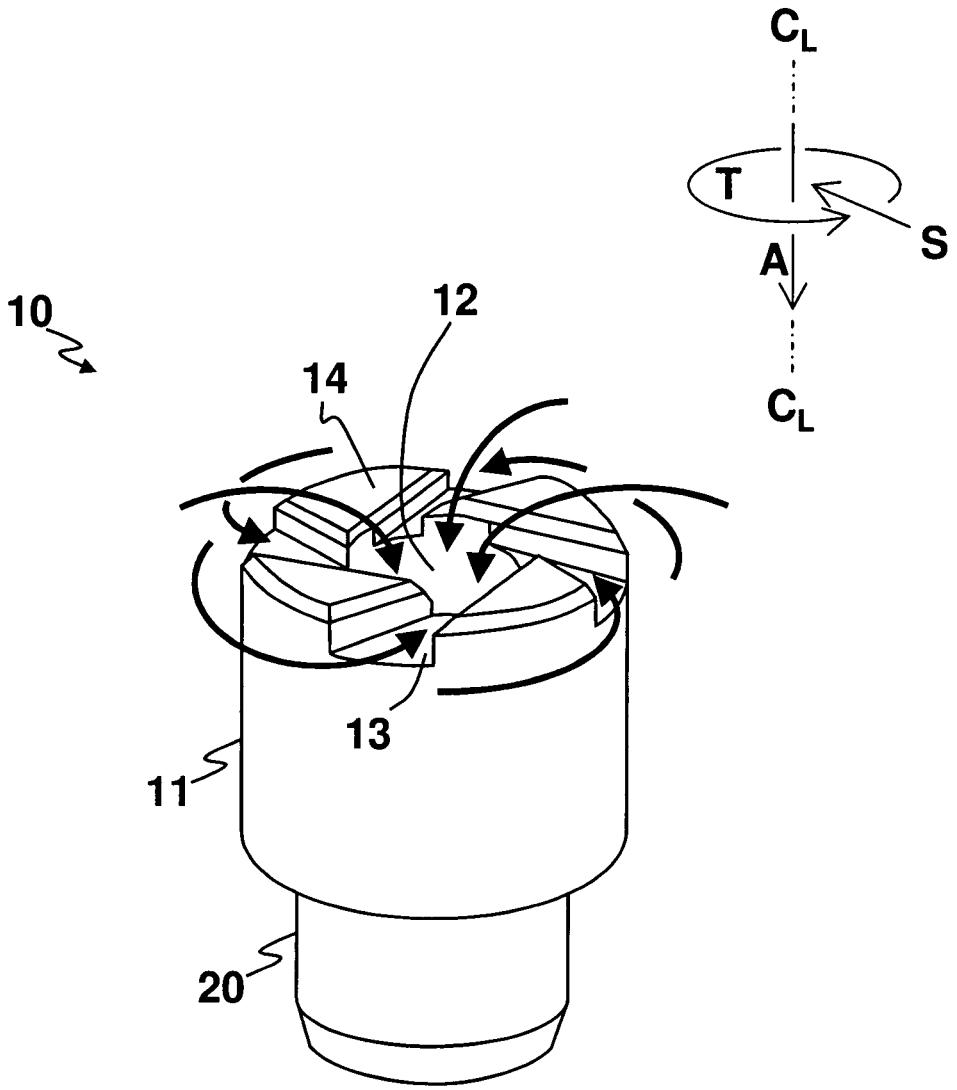
FIG. 5 is a perspective view of a vortex flow pattern in proximity to the vacuum suction nozzle of FIG. 2.

FIG. 5 is a perspective view of a vortex flow pattern in proximity to nozzle 10 with coupling adapter 20, as shown in FIG. 2. FIG. 5 illustrates vortex flow with tangential, radial, and axial components, as illustrated by representative flow arrows T, S, and A, respectively, in the sketch to the upper right of nozzle 10.

Tangential flow velocity increases with decreasing axial and radial distance from nozzle body 11, and is greatest in proximity to first end 14. Radial flow velocity also increases in proximity to first end 14, particularly as the flow traverses first end 14 to nozzle passage 12. Axial flow increases with decreasing distance from first end 14 and axial centerline $C_L$, and becomes dominant as the flow continues down nozzle passage 12 through nozzle body 11.

FIG. 5 illustrates the design of nozzle 10, which does not require vortex-inducing nozzles or vanes, a combination of suction and pressure flows, or other complexities. The vortex flow illustrated by FIG. 5 depicts a cyclonic flow structure with a generally cylindrical geometry, as opposed to a toroidal flow structure, a compound flow structure, or other more complex flow geometry.

Nozzle passage 12 also reflects this design approach, having a substantially uniform circular cross section extending from first end 14 through nozzle body I1 to second end 15 and optional coupling adapter 20. Nozzle passage 12 does not require non-uniform interior structures, multi-chambered elements, or other complicated nozzle passage geometries.

Note also that channels 13 are operative to induce vortex flow proximate nozzle 10, including regions exterior to inner radius r of nozzle passage 12, and exterior to outer radius R of nozzle body 11. This provides a greater effective vortex flow area. Vortex flow is also inherent to the design of nozzle 10; that is, it does not require contact with, or even close proximity to, the surface to be cleaned. Nozzle 10 is thus suitable to applications where close proximity is either impractical or undesirable, because of the surface's susceptibility to scratching and contamination, non-uniformities such as edges, holes, dimples, or ridges, or due to some other operating consideration.

Figure 6:
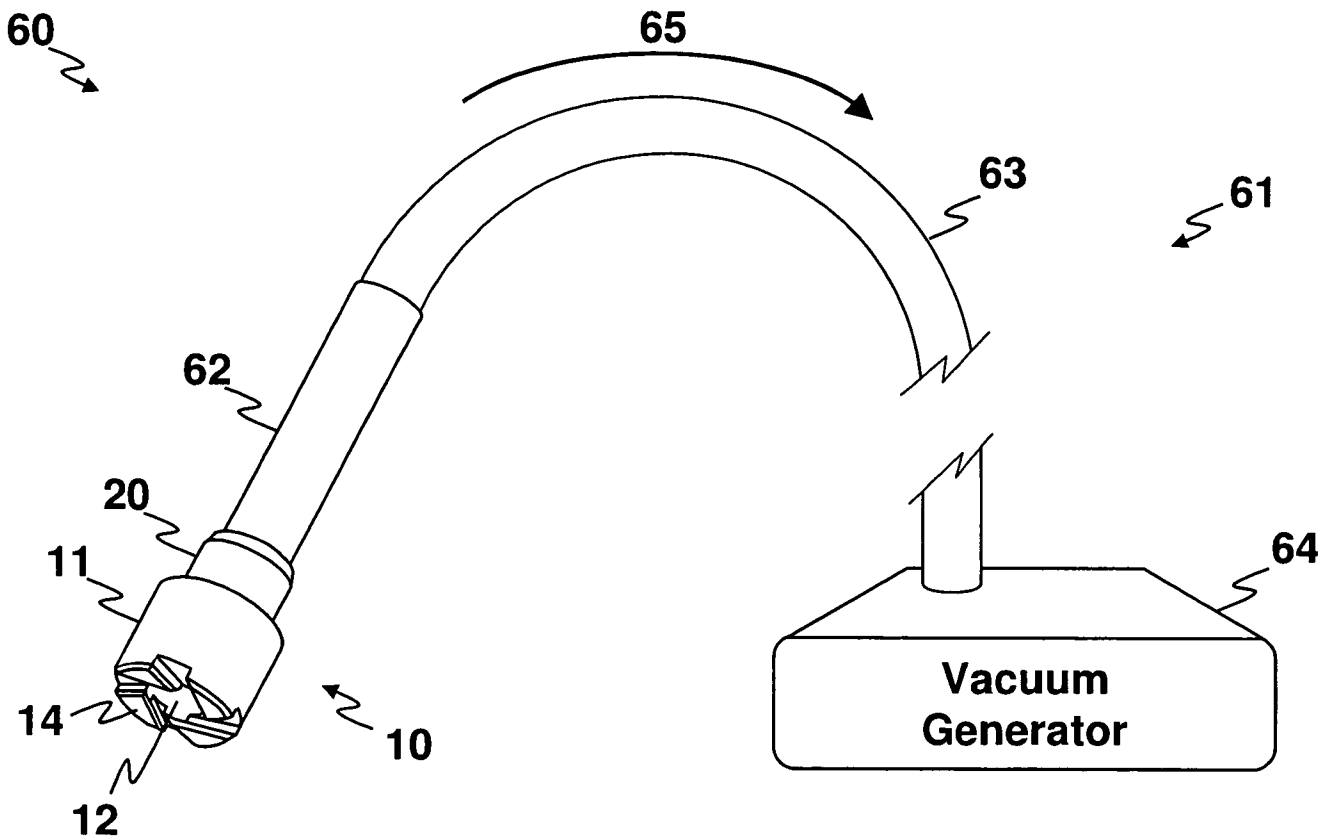
FIG. 6 is a schematic diagram of a vortex-flow vacuum cleaning system.

FIG. 6 is a schematic diagram of vortex-flow vacuum cleaning system 60, comprising vacuum suction nozzle 10 and vacuum generator 61. Nozzle 10 comprises nozzle body 11, nozzle passage 12, channels 13 and coupling adapter 20, as described above with respect to FIG. 2. Vacuum generator 61 comprises vacuum receiving element 62, vacuum flow element 63, and vacuum source 64.

Vacuum receiving element 62 may be a vacuum suction nozzle, a vacuum wand, a vacuum accessory, or other vacuum receiving element. Vacuum flow element 63 may be a vacuum hose, a vacuum pipe, a vacuum duct, a vacuum conduit, or other vacuum flow element, or a combination of vacuum flow elements. In some embodiments, vacuum flow element 63 comprises vacuum receiving element 62, and in other embodiments they are distinct.

Vacuum source 64 is operable to induce a fluid flow through vacuum flow element 63 and vacuum receiving element 62. Vacuum source 64 may induce a gaseous fluid flow, a liquid fluid flow, or a complex phase flow, and may be directed toward a general-purpose vacuum cleaning system, a high-pressure or high-flow vacuum system, or another specific vacuum application.

In one embodiment, vacuum generator 61 is a commercially available vacuum generator, additionally comprising a debris separation apparatus and a HEPA-type filter apparatus. Vacuum generator 61 may also be a particle counting apparatus, such as a LASAIR 310-series particle counter.

In operation of system 60, vacuum generator 61 induces fluid flow in vacuum receiving element 62 and vacuum flow element 63, in the direction of vacuum source 64 as indicated by flow arrow 65. This induces flow through nozzle passage 12 of nozzle 10, and through channels 13. Flow in channels 13, in turn, induces vortex flow in proximity to nozzle 10, and in particular proximate first end 14 of nozzle body 11.

Nozzle 10 is then positioned with respect to a surface such as the surface of a clean room fixture or other sensitive fabrication apparatus. Vortex flow in proximity to nozzle 10 induces the removal of particulates and other debris, which flow across first end 14 of nozzle body 11 and into nozzle passage 12, then through vacuum receiving element 62 and vacuum flow element 63 into vacuum source 64.

Because system 60 is effective at removing particulates and other debris in proximity to nozzle 10, it does not require contact with, or even any particular spacing from, the surface to be cleaned. Thus system 60 does not require a wheeled, sliding, or other nozzle carriage device, and system 60 is appropriate to small areas, irregular geometries, and sensitive surfaces susceptible to scratching or contamination.

TABLE 1 illustrates the operation of system 60, in an embodiment where vacuum generator 61 is a LASAIR 310-series particle counter. In this embodiment receiving element 62 is the LASAIR 310-series vacuum nozzle, to which coupling adapter 20 establishes a detachable friction coupling by simply sliding over the 310-series vacuum nozzle.

TABLE 1

PARTICULATE REMOVAL

| | 0.3 μm | | | | 0.5 μm | | | |
|---|---|---|---|---|---|---|---|---|
| Station | $N_1$ | $N_2$ | E | $E_f$ | $N_1$ | $N_2$ | E | $E_f$ |
| 1 | 1001 | 20 | 98.0% | ≈50X | 283 | 2 | 99.3% | ≈140X |
| 2 | 214 | 0 | 100.0 | >200 | 76 | 0 | 100.0 | >70 |
| 3 | 377 | 0 | 100.0 | >300 | 77 | 0 | 100.0 | >70 |
| 4 | 78 | 1 | 98.7 | ≈78 | 29 | 0 | 100.0 | >20 |
| 5 | 147 | 0 | 100.0 | >100 | 12 | 0 | 100.0 | >10 |
| 6 | 410 | 1 | 99.8 | ≈400 | 122 | 0 | 100.0 | >100 |
| 7 | 115 | 1 | 99.1 | ≈100 | 22 | 0 | 100.0 | >20 |
| 8 | 249 | 0 | 100.0 | >200 | 19 | 0 | 100.0 | >10 |

TABLE 1 provides data obtained from eight different stations of a clean-room fixture. The fixture may be used, for example, to fabricate disk drive components. The stations were prepared with a standard mechanical soft-cloth wipe down procedure, and preliminary particle counts ($N_1$) were made with the LASAIR 310 particle counter. Next, the station was cleaned with system 60 and nozzle 10, using the LASAIR 310 as vacuum generator 61. Then nozzle 10 was removed, and residual particle counts ($N_2$) were taken for comparison. These procedures covered two particulate size ranges, of approximately 0.3 μm (left-hand columns) and 0.5 μm (right-hand columns).

In TABLE 1, the cleaning efficiency E is simply the fraction of particles removed; that is, $E=(N_1-N_2)/N_1$. System 60 with nozzle 10 demonstrates high cleaning efficiency, ranging from approximately 98% to 100% for 0.3 μm particulates, and from approximately 99% to 100% for 0.5 μm particulates.

Another measure of performance is the efficacy, $E_f$, which is the ratio of original particle count $N_1$ to residual count $N_2$. Essentially, the efficacy measures the relative reduction in particulates; that is, it measures how much cleaner the station is after application of system 60 with nozzle 10, as compared to the mechanical wipe down alone. Note that the efficacy is actually unbounded when the residual count is zero ($N_2=0$), which occurs in several of the stations. In these cases an approximate minimum value is used, based on original count $N_1$. Regardless, $E_f$ remains high, ranging from approximately 50× to more than 400× for 0.3 μm particulates, and from at least 10× to more than 100× for 0.5 μm particulates. This illustrates that system 60 with nozzle 10 is both efficient and efficacious when applied to a range of sensitive fabrications surfaces, as represented by the clean room fixture stations in TABLE 1.

The terminology used herein is for the purpose of description, not limitation. The specific structural and functional details disclosed are not to be interpreted as limiting, but merely as bases for teaching one skilled in the art to variously employ the embodiments. Although the nozzle has been described with reference to preferred embodiments, workers skilled in the art will recognize that changes may be made in form and detail without departing from the spirit and scope of the invention.

The invention claimed is:

1. A vacuum suction nozzle comprising:

a nozzle body having a first end and a second end;

a nozzle passage extending through the nozzle body from the first end to the second end; and a plurality of channels each traversing the first end of the nozzle body and each intersecting the nozzle passage tangentially, wherein each channel is defined by opposing channel walls that are separated widest proximate an outer surface of the nozzle body and separated narrowest proximate the nozzle passage.

2. The nozzle of claim 1, wherein the nozzle body is comprised of acetal or a copolymer or blend thereof.

3. The nozzle of claim 1, wherein the nozzle body has a substantially cylindrical geometry.

4. The nozzle of claim 3, wherein an outer radius of the nozzle body is approximately twice an inner radius of the nozzle passage.

5. The nozzle of claim 1, wherein the nozzle body comprises a static dissipative material.

6. A vacuum suction nozzle comprising a nozzle body having a first end and a second end, an arcuate surface defining a nozzle passage extending through the nozzle body from the first end to the second end, and a plurality of channel walls defining a plurality of channels traversing the first end of the nozzle body, each channel wall tangent to the arcuate surface so that each channel intersects the nozzle passage tangentially.

7. The nozzle of claim 6, wherein the plurality of channels are beveled such that an intake lip is presented on the first end.

8. The nozzle of claim 6, wherein the plurality of channels comprises four channels.

9. The nozzle of claim 6, characterized by each channel being defined by a tangent opening angle of approximately thirty degrees.

10. The nozzle of claim 6, additionally comprising a coupling adapter located at the second end of the nozzle body.

11. A vacuum cleaning system comprising:

a vacuum nozzle having a nozzle body extending between first and second ends, an arcuate surface defining a nozzle passage extending through the nozzle body from the first end to the second end, and a plurality of channel walls defining a plurality of channels traversing the first end of the nozzle body, each channel wall tangent to the arcuate surface so that each channel intersects the nozzle passage tangentially; and a vacuum generator coupled to the second end of the nozzle body.

12. The system of claim 11, wherein the nozzle is configured to remove particulates of less than about one micron from surfaces proximate the nozzle.

13. The system of claim 11, wherein the vacuum generator is operative to induce an air flow.

14. The system of claim 11, wherein the vacuum generator is operative to induce a liquid flow.

15. A method for vacuum cleaning, the method comprising:

inducing a vortex flow via a vacuum nozzle in fluid communication with a vacuum generator, the nozzle having a nozzle body extending between first and second ends, an arcuate surface defining a nozzle passage extending through the nozzle body from the first end to the second end, and a plurality of channel walls defining a plurality of channels traversing the first end of the nozzle body, each channel wall tangent to the arcuate surface so that each channel intersects the nozzle passage tangentially; and translating the nozzle generally parallel to a surface to remove particulates from the surface.

16. The method of claim 15, wherein translating the nozzle comprises translating the nozzle generally parallel to a surface of a clean room apparatus.

17. The method of claim 15, wherein translating the nozzle comprises translating the nozzle such that it does not contact the surface.

18. The method of claim 15, wherein translating the nozzle comprises translating the nozzle to remove particulates of less than about one micron from the surface.

19. The nozzle of claim 1, characterized by each channel being defined by a tangent opening angle of approximately thirty degrees.

* * * * *